US010038235B2

(12) United States Patent
DiNallo et al.

(10) Patent No.: US 10,038,235 B2
(45) Date of Patent: Jul. 31, 2018

(54) MULTI-MODE, MULTI-BAND ANTENNA

(71) Applicant: Maxtena, Inc., Rockville, MD (US)

(72) Inventors: Carlo DiNallo, Plantation, FL (US); Simone Paulotto, Rockville, MD (US); Nathan Cummings, Gaithersburg, MD (US)

(73) Assignee: Maxtena, Inc., Rockville, MD (US)

( * ) Notice: Subject to any disclaimer, the term of this patent is extended or adjusted under 35 U.S.C. 154(b) by 945 days.

(21) Appl. No.: 14/197,166

(22) Filed: Mar. 4, 2014

(65) Prior Publication Data

US 2014/0253410 A1 Sep. 11, 2014

Related U.S. Application Data

(60) Provisional application No. 61/772,840, filed on Mar. 5, 2013.

(51) Int. Cl.
*H01Q 1/36* (2006.01)
*H01Q 5/357* (2015.01)
(Continued)

(52) U.S. Cl.
CPC ..... *H01Q 1/362* (2013.01); *H01Q 5/35* (2015.01); *H01Q 5/357* (2015.01); *H01Q 11/08* (2013.01); *H01Q 21/30* (2013.01)

(58) Field of Classification Search
CPC ..... H01Q 1/362; H01Q 11/08; H01Q 21/30; H01Q 5/357; H01Q 5/35
(Continued)

(56) References Cited

U.S. PATENT DOCUMENTS 4,554,554 A * 11/1985 Olesen ..... H01Q 1/362 343/895
5,600,341 A * 2/1997 Thill ..... H01Q 1/242 343/702
(Continued)

FOREIGN PATENT DOCUMENTS

CN 102227037 A 10/2011
RU 2315427 C2 1/2008

OTHER PUBLICATIONS

PCT International Search Report for PCT/US 2014/020737 (PCT version of this application).

*Primary Examiner* — Dameon E Levi
*Assistant Examiner* — Ab Salam Alkassim, Jr.
(74) *Attorney, Agent, or Firm* — Patents and Licensing LLC; Daniel W Juffernbruch

(57) ABSTRACT

A multi-mode, multi-band antenna system for a handheld wireless device includes a Quadrafilar Helix Antenna (QHA) that radiates circularly polarized waves is fed by a co-axial cable. The co-axial cable is also used in combination with the QHA as a monopole antenna. Because of the distinct electromagnetic field patterns of the QHA versus the combination of the QHA and the co-axial cable operating as a monopole antenna, the cross coupling between the two modes is low. In certain embodiments the co-axial cable can itself be formed into a helix in order to reduce the physical length of the antenna system while maintaining an electrical length desired to supported certain frequency bands in the monopole mode. According to certain embodiments a post which also serves to increase the effective electric length of the co-axial cable and thereby support a lower frequency band is provided along the centerline of the QHA.

14 Claims, 7 Drawing Sheets

(51) Int. Cl.
*H01Q 5/35* (2015.01)
*H01Q 11/08* (2006.01)
*H01Q 21/30* (2006.01)

(58) Field of Classification Search
USPC ..... 343/895
See application file for complete search history.

(56) References Cited

U.S. PATENT DOCUMENTS 5,606,332 A * 2/1997 Darden, IV ..... H01Q 1/242 343/702
5,945,964 A * 8/1999 DeGroot ..... H01Q 1/244 343/702
5,963,180 A * 10/1999 Leisten ..... H01Q 5/357 333/126
5,986,619 A 11/1999 Grybos et al.
6,150,983 A * 11/2000 Massey ..... H01Q 1/242 333/125
6,181,286 B1 * 1/2001 Roscoe ..... H01Q 1/362 343/702
6,222,505 B1 * 4/2001 Endo ..... H01Q 1/242 343/702
6,334,048 B1 * 12/2001 Edvardsson ..... H01Q 11/08 343/702
6,459,916 B1 * 10/2002 Suguro ..... H01Q 1/244 343/702
6,781,549 B1 * 8/2004 Macqueen ..... H01Q 1/242 343/702
7,408,515 B2 * 8/2008 Leisten ..... H01Q 9/0421 343/702
7,545,340 B2 * 6/2009 Takaoka ..... H01Q 1/362 343/702
7,675,477 B2 * 3/2010 Leisten ..... H01Q 11/08 343/895
9,007,270 B2 * 4/2015 Ngo Bui Hung ..... H01Q 5/00 343/787
2002/0123312 A1 * 9/2002 Hayes ..... H01Q 1/242 455/575.7
2008/0180334 A1 * 7/2008 Vincent ..... H01Q 9/30 343/745
2009/0115677 A1 * 5/2009 Chung ..... H01Q 9/30 343/791
2009/0153430 A1 6/2009 Hung et al.
2010/0013736 A1 * 1/2010 Ogawa ..... H01Q 1/38 343/895
2010/0127952 A1 * 5/2010 Henry ..... H01Q 1/362 343/895
2011/0254755 A1 10/2011 DiNallo
2013/0009832 A1 * 1/2013 Apostolos ..... H01Q 1/273 343/730
2015/0244075 A1 * 8/2015 Platt ..... H01Q 1/38 343/792
2015/0311584 A1 * 10/2015 Babitski ..... H01Q 9/32 343/792

* cited by examiner

MULTI-MODE, MULTI-BAND ANTENNA

RELATED APPLICATION DATA

This application is based on provisional application Ser. No. 61/772,840 filed Mar. 5, 2013.

FIELD OF THE INVENTION

The present invention relates generally to wireless communication.

BACKGROUND

While cellular telephone networks and wireless local area networks (LANs) provide ready access to global communication networks from cities, suburbs and even rural areas in the developed world, there are still vast areas of the world where access to communication via the aforementioned wireless communications or via regular telephone networks is not available. In such instances communications via satellites is a viable option. Satellite communications can be useful to a variety of civilian and military users. Certain communication satellites systems use directional antennas that cover a limited geographic region. For people who travel extensively it would be desirable to have portable wireless communication devices that are able to communicate using multiple communication systems e.g., terrestrial cellular systems and satellites.

Additionally different types of communication services may be available in the same geographic from different sources (e.g., satellites, radio towers) and using different frequency bands. In order for the portable communication device to utilize each source it must include an antenna that exhibits the appropriate frequency response and has a gain pattern consistent with the frequency and the location of the source with which it is communing. For example while a gain pattern that is strong at relatively low zenith angles, is appropriate for communicating with overhead satellites, a gain pattern that is stronger at somewhat higher zenith angles may be more suitable for exchanging signals with a terrestrial antenna. Adding multiple antennas to a portable (e.g., handheld) device to handle multiple needs can lead to an excessively bulky and unwieldy device. Furthermore multiple antennas could interfere with each other.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
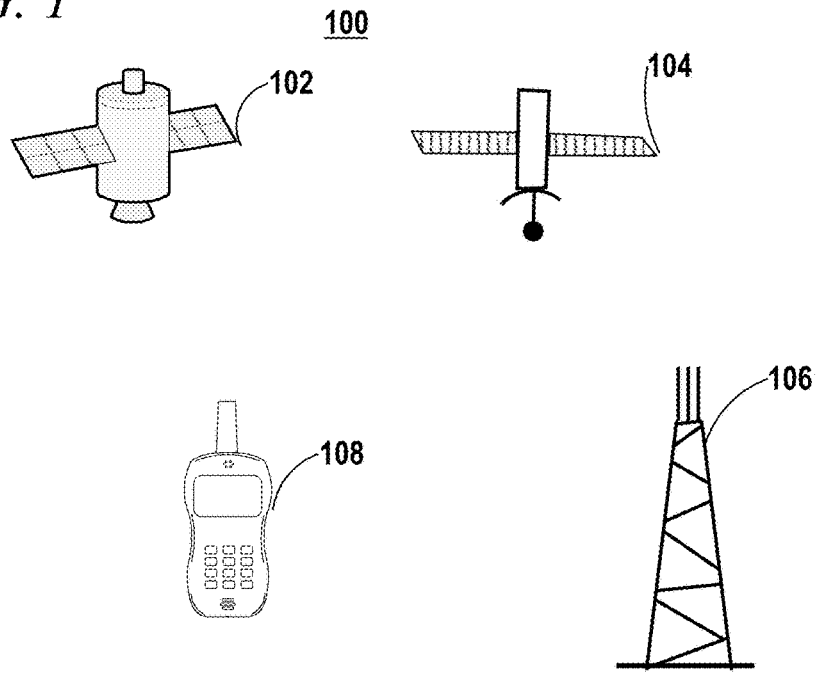
FIG. 1 shows a wireless communication environment including multiple disparate wireless communication system infrastructure devices that communicate with a single wireless handset.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to antennas. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

FIG. 1 shows a wireless communication environment 100 including multiple disparate wireless communication system infrastructure devices 102, 104, 106 that communicate with a single wireless handset 108. The infrastructure devices 102, 104, 106 include a first communication satellite 102, a second communication satellite 104 and a terrestrial radio tower 106. The two communication satellites 102, 104 can support communications using different frequency bands and/or using different protocols. The terrestrial radio tower 106 may for example support cellular mobile telephone communications or municipal two-way radio communications.

Figure 2:
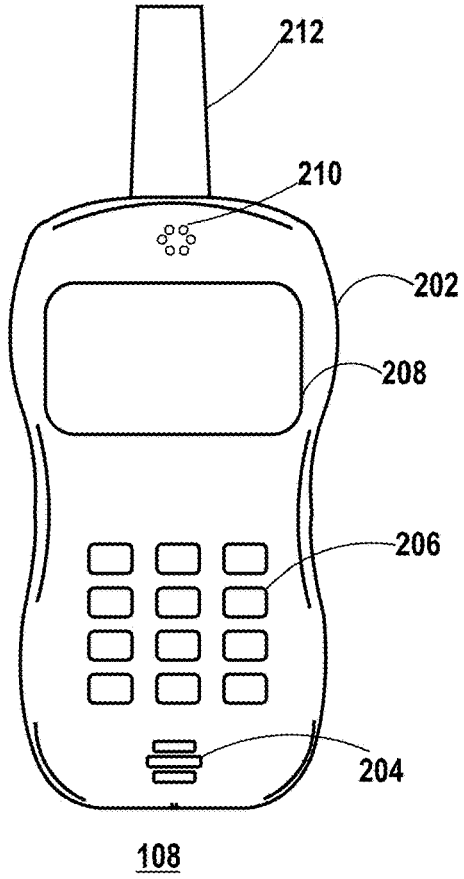
FIG. 2 is a front view of a wireless communication handset according to an embodiment of the invention.

FIG. 2 is a front view of the wireless communication handset 108 according to an embodiment of the invention. The wireless handset 108 includes a housing 202, a microphone 204, a keypad 206, a display 208, a speaker 210 and an antenna housing 212 that encloses certain components of an antenna system 302 (FIG. 3) that includes two tightly integrated antennas. The antenna system 302 (FIG. 3) is effectively a "two-in-one" antenna. According to alternative embodiments of the invention, antenna systems according to the teachings of the present invention are incorporated in different types wireless communication equipment having form factors other than what is shown in FIG. 2. For example antenna systems according to teachings of the present invention could be included in laptop computers or in vehicle mounted radios.

Figure 3:
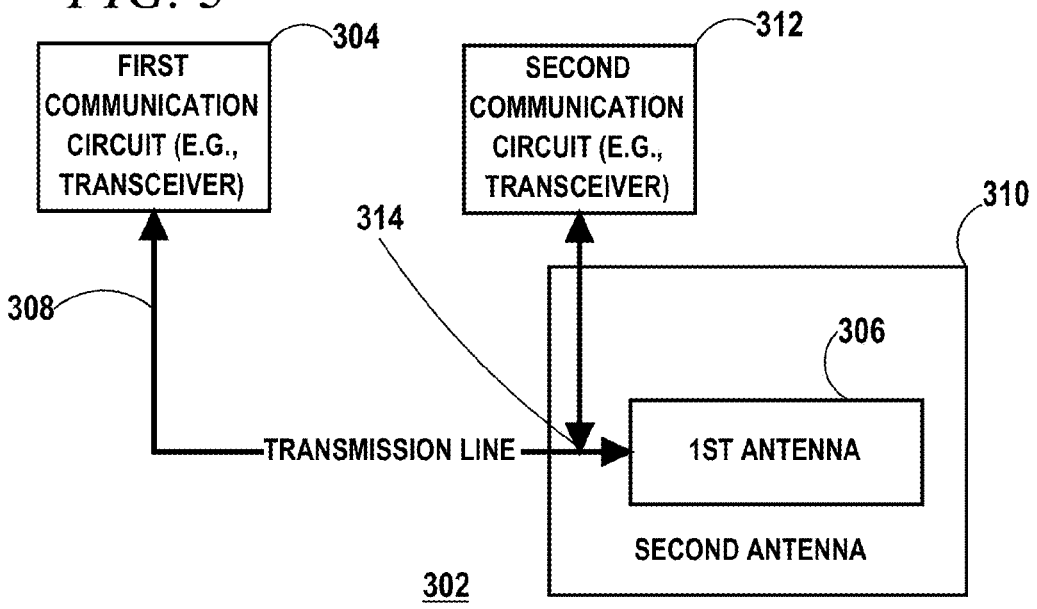
FIG. 3 is a schematic of an antenna system and related circuits of the handset shown in FIG. 2 according to an embodiment of the invention.
Figure 4:
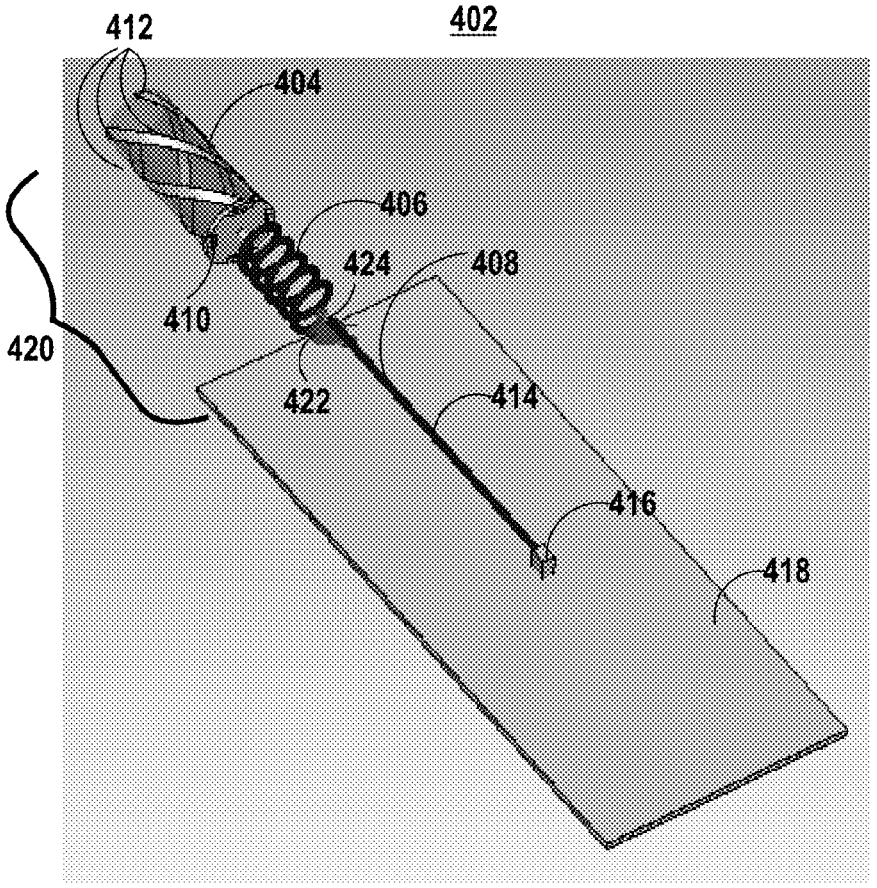
FIG. 4 is a perspective view of the wireless antenna system shown in FIG. 3 according to an embodiment of the invention.
Figure 5:
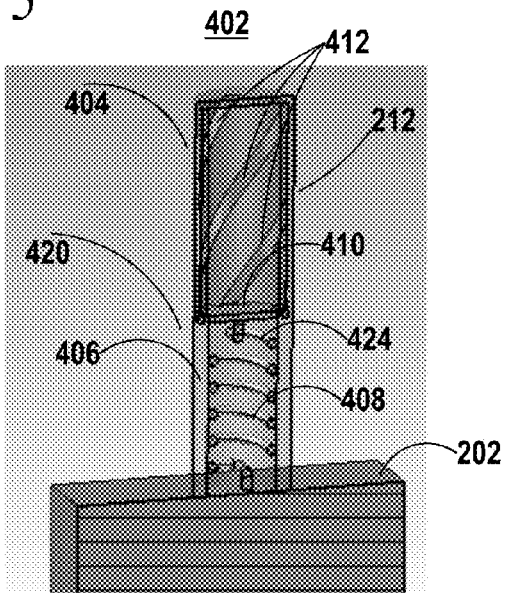
FIG. 5 is a fragmentary cross sectional view of the antenna system shown in FIG. 4.
Figure 6:
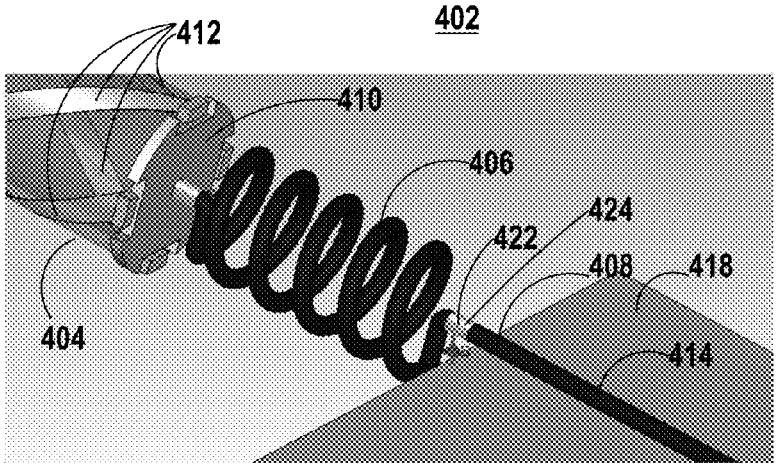
FIG. 6 shows an enlarged portion of the antenna system shown in FIGS. 4-5.
Figure 7:
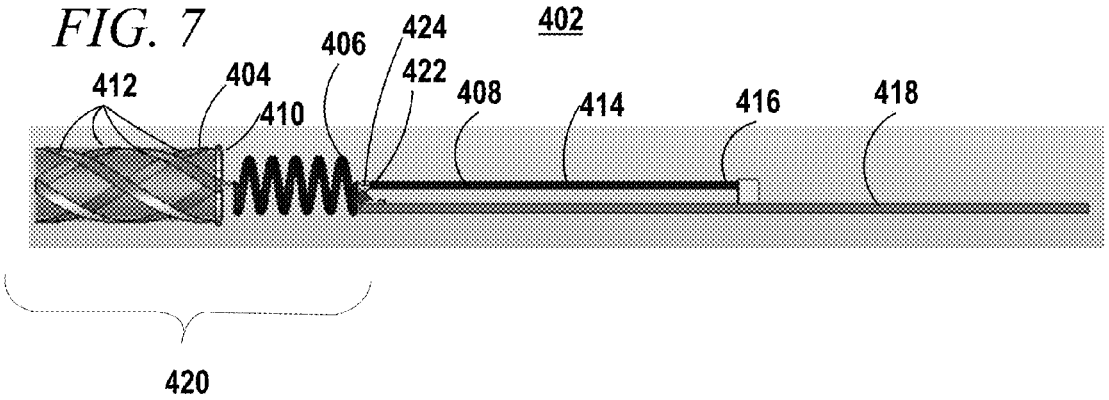
FIG. 7 is a side view of the antenna system shown in FIGS. 4-6.

FIG. 3 is a schematic of the antenna system 302 and related circuits of the handset shown in FIG. 2 according to an embodiment of the invention. The antenna system 302 includes a first communication circuit (e.g., transceiver) 304 coupled to a first antenna 306 through a transmission line 308 (e.g., co-axial cable). A second antenna 310 comprises the first antenna 306 and the transmission line 308. A second communication circuit (e.g., transceiver) 312 is coupled to the second antenna 310 at an intermediate position 314 along the length of the transmission line 308. The first antenna 306 and the second antenna 310 operate in completely separate modes and at different frequencies.

FIGS. 4-7 show various views of an antenna system 402 that is one embodiment of the antenna system 302. The antenna system 402 includes a quadrifilar helical antenna (QHA) 404 mounted atop a coiled (helically shaped) section 406 of a co-axial cable 408. The co-axial cable 408 is used to couple signals to and/or from the QHA 404. When used in the wireless handset 108 the QHA 404 and the coiled section 406 of co-axial cable 408 are suitably positioned in the antenna housing 212.

The QHA 404 includes a round circuit board 410 from which extend four helical antenna elements 412. A phase shift network (not shown) which supplies the helical elements 412 of the QHA 404 with signals phase shifted at 0, $\pi/2$, $\pi$, and $3\pi/2$ is implemented on the round circuit board 410.

An un-coiled section 414 of the co-axial cable 408 extends back in the direction away from the QHA 404 from the coiled section 406 to a feed end 416 that plugs into a main circuit board 418. The first communication circuit 304 (not shown in FIGS. 4-7) can be implemented on the main circuit board 418 and coupled to the QHA 404 through the feed end 416 of the co-axial cable 408. The feed end 416 serves as the first of two feed points for the antenna system 402.

A second antenna 420 includes the QHA 404 and the coiled section 406 of the co-axial cable 408 as active elements. Thus no extra radiating antenna elements are required for the second antenna 420. A feed point 422 for the second antenna 420 is located near the juncture of the coiled section 406 and the un-coiled section 414 of the co-axial cable 408. At the feed point 422 signals are coupled to the second antenna 310 via a connection to the outer conductor 424 of the co-axial cable 408. The co-axial cable 408 can be sheathed in an insulating jacket which can be partially removed to expose the outer conductor 424 at the feed point 422. The second communication circuit 312 (not shown in FIGS. 4-7) can be implemented on the main circuit board 418. The second communication circuit 312 is coupled to the feed point 422 through an impedance matching network 800 shown in FIG. 8.

Figure 8:
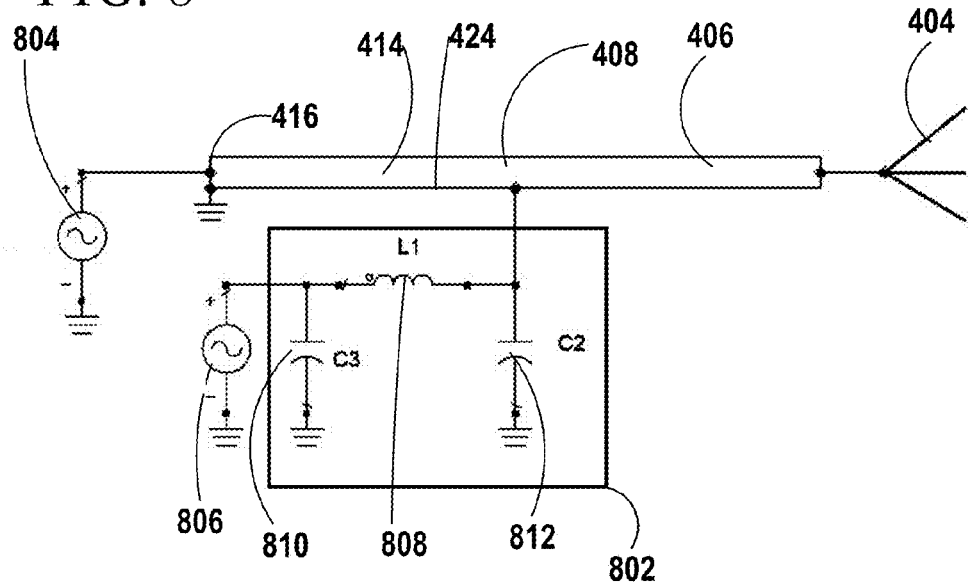
FIG. 8 is a schematic of the antenna system shown in FIGS. 4-7 including an impedance matching network according to an embodiment of the invention.
Figure 9:
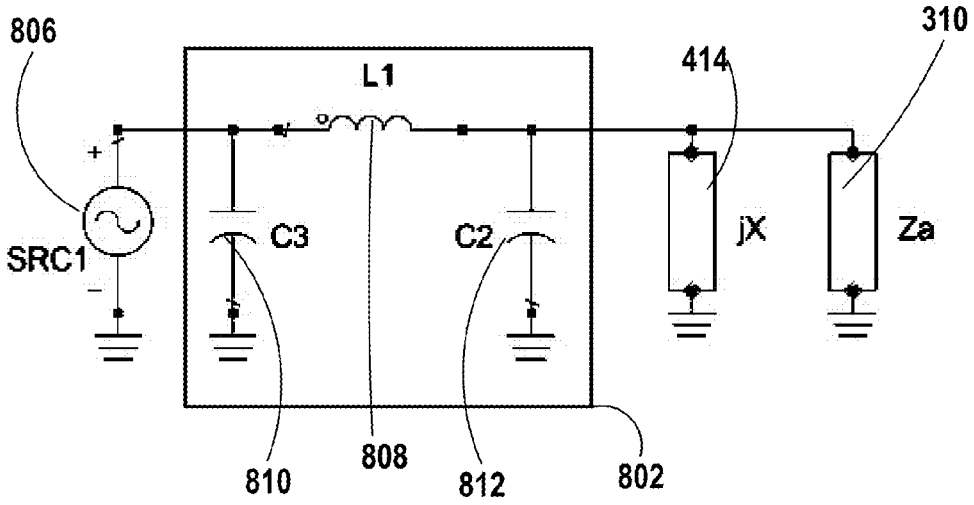
FIG. 9 is an equivalent circuit for the impedance matching network shown in FIG. 8.

FIG. 8 is a schematic of the antenna system 402 including an impedance matching network 802 according to an embodiment of the invention. A first signal source 804 which represents a part of the first communication circuit 304 is coupled to the feed end 416 of the co-axial cable 408. A second signal source 806 which represents a part of the second communication circuit 312 is coupled through the impedance matching network 802 to the outer conductor 424 of the co-axial cable 408. The impedance matching network 802 is a Pi network. The impedance matching network 802 includes an inductor 808 in series between the second signal source 806 and the outer conductor 424 of the co-axial cable 408, a first capacitor 810 connecting the juncture of the inductor 808 and the second signal source 806 to ground and a second capacitor 812 connected the juncture between the inductor 808 and the outer conductor 424 to ground. FIG. 9 is an equivalent circuit for the impedance matching network shown in FIG. 8. In FIG. 9 the uncoiled section 414 of the co-axial cable 408 appears as a shunt inductive impedance which loads the impedance matching network 802 in parallel with the second antenna 310.

The QHA 404 radiates circularly polarized waves in a pattern that has strong gain in the upward direction aligned with the longitudinal axis of the QHA 404. On the other hand the second antenna 420 emits a dipole radiation pattern having a null in the upward direction aligned with the longitudinal axis of the QHA 404, and having larger gain in directions perpendicular to the longitudinal axis of the QHA 404. A portion of the QHA 404/co-axial cable 408 combination serves as a first monopole and the main circuit board 418 can serve as an opposite monopole or as a counterpoise for the first monopole, when the second antenna 420 is being utilized.

Figure 10:
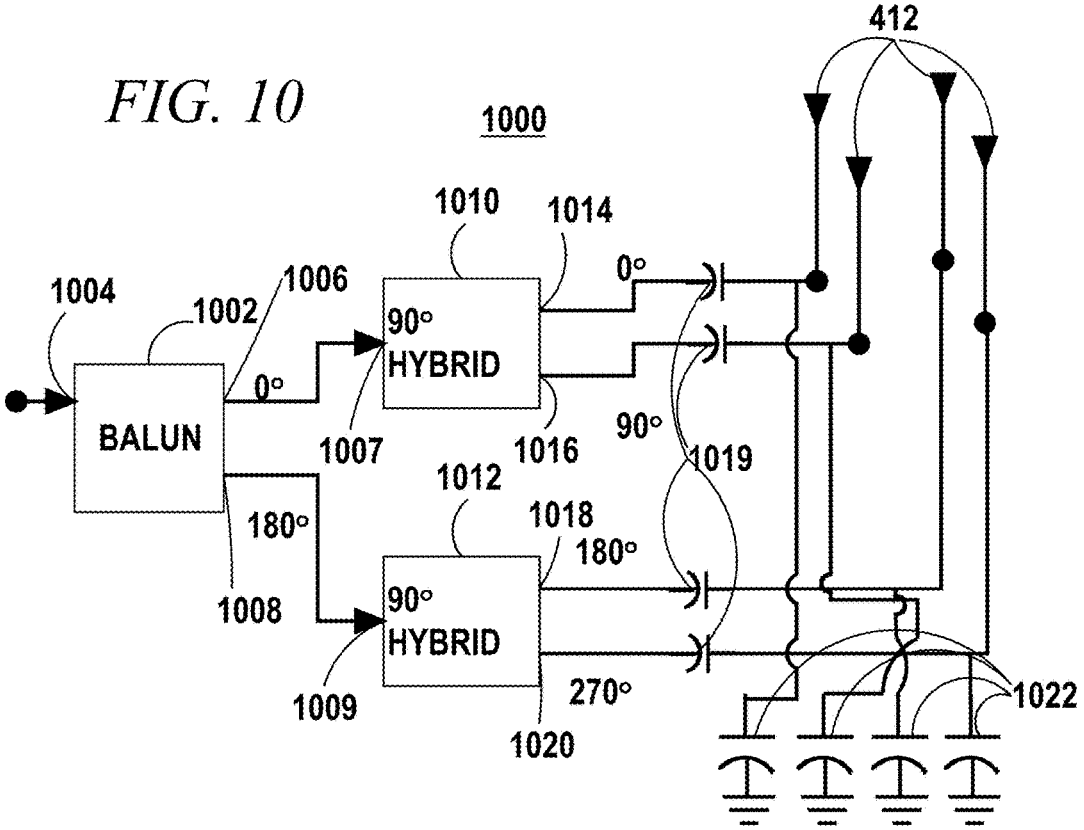
FIG. 10 is a schematic of a feed network for a Quadrifilar Helical Antenna (QHA) included in the antenna system shown in FIGS. 4-7 according to an embodiment of the invention.

FIG. 10 is a schematic of a feed network 1000 for the QHA 404 included in the antenna system 402 shown in FIGS. 4-9 according to an embodiment of the invention. The feed network 1000 can be implemented on the round circuit board 410. Referring to FIG. 10 the feed network 1000 includes a balun 1002 that has an input port 1004 for receiving signals through the co-axial cable 408 from the first communication circuit 304. The balun 1002 has a 0° output 1006 and a 180° output 1008. The 0° output 1006 of the balun 1002 is connected to an input 1007 of a first 90° degree hybrid 1010 and the 180° output 1008 of the balun 1002 is connected to an input 1009 of a second 90° degree hybrid 1012. The first 90° degree hybrid 1010 has a first output 1014 that provides an output at 0° and a second output 1016 that provides an output at 90°. The second 90° degree hybrid 1012 has a first output 1018 that provides an output at 180° and a second output 1020 that provides an output at 270°. The outputs 1014, 1016, 1018, 1020 of the 90° degree hybrids 1010, 1012 thus provide four signals spaced by 90° in phase to the four helical elements 412. The outputs 1014, 1016, 1018, 1020 of the 90° degree hybrids 1010, 1012 are coupled to the four helical elements 412 through a set of four coupling capacitors 1019. Each of the helical elements 412 is coupled to a ground plane of the round circuit board 410 (not shown in FIG. 10) through one of four capacitors 1022. When the second antenna 310 is being used and the four helical elements 412 are serving as an extension of the coiled section 406 of the co-axial cable 408, radiating a dipole pattern, a displacement current passing through the four capacitors 1022, as well as through inherent capacitance between the feed network 1000 and the ground plane (not shown) of the round circuit board 410 will serve to couple the four helical elements 412 to the coiled section 406 of the co-axial cable 408.

Figure 11:
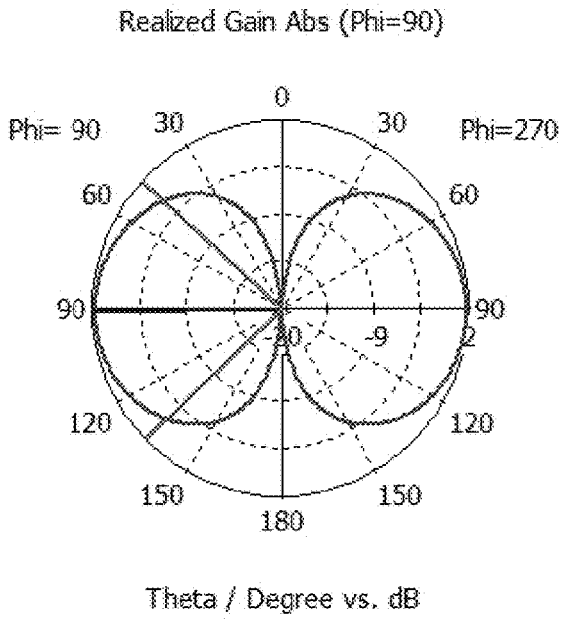
FIG. 11 is a polar gain plot for the antenna system shown in FIGS. 4-10 when operating in dipole mode.
Figure 12:
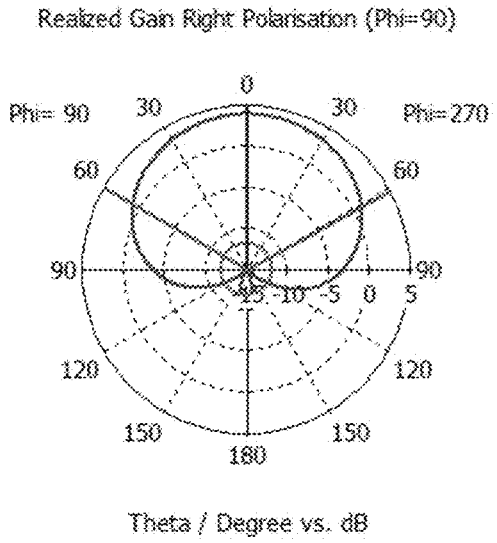
FIG. 12 is a polar gain plot for the antenna system shown in FIGS. 4-10 when operating in Quadrafilar Helix Antenna (QHA) mode.
Figure 13:
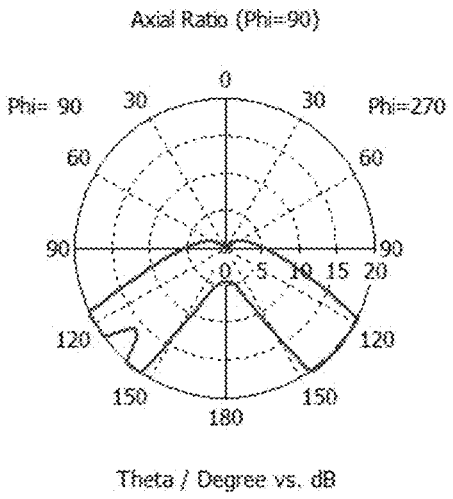
FIG. 13 is polar plot of axial ratio for the antenna system shown in FIGS. 4-10 when operating in QHA mode.

FIG. 11 is a polar gain plot for the antenna system 402 shown in FIGS. 4-8 when operating in dipole mode associated with the second antenna 420. FIG. 12 is a polar gain plot for the antenna system 402 shown in FIGS. 4-8 when operating in QHA mode. FIG. 13 is polar plot of axial ratio for the antenna system 402 shown in FIGS. 4-8 when operating in QHA mode.

Figure 14:
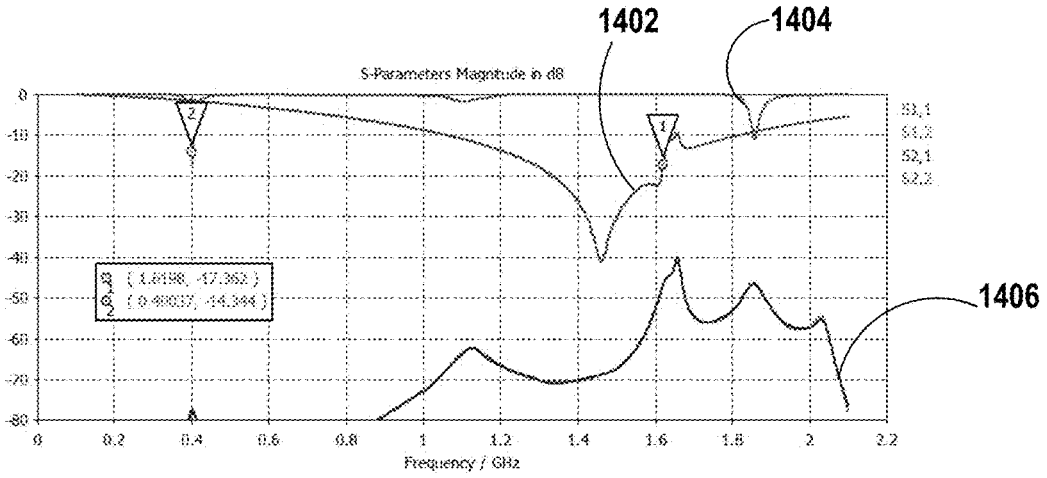
FIG. 14 is a graph of certain S-parameters for the antenna system shown in FIGS. 4-10.

FIG. 14 is a graph of certain S-parameters for the antenna system 402 shown in FIGS. 4-10. Port 1 in FIG. 14 corresponds to the feed end 416 through which signals are coupled to the QHA 404. Port 2 in FIG. 14 corresponds to the feed point 422 used to feed the second antenna 420. Plot 1402 is the return loss (S11) for the QHA 404 and plot 1404 is the return loss S22 for the second antenna 420. The QHA 404 supports an operating band centered at about 1.62 GHz and the second antenna 420 exhibits a fundamental resonance operating band at 400 MHz. The frequency of the operating band of the second antenna 420 can be adjusted by changing the length of the coiled section 406 of the co-axial cable 408. The first communication circuit 304 is adapted to transmit and/or receive signals at a frequency corresponding to an operating band of the QHA, which in the case of FIG. 14 is as shown, but can vary in other embodiments of the invention. The coiled section 406 of the co-axial cable 408 has a length chosen in view of the additional length provided by the QHA 404, or post 1502 (FIG. 15) to support an antenna resonance band at frequency corresponding to a frequency at which the second communication circuit 312 is adapted to send and/or receive signals.

Plot 1406 is a plot of coupling between port 2 and port 1. As shown the coupling is limited to a maximum of −40 dB. Thus the two ports are well isolated. Isolation is due in part to the fact that the near field radiation patterns of the QHA 404 and the second antenna 420 are largely uncorrelated (decoupled). Isolation is also due in part to the fact that operation of second antenna would tend to drive equal, in-phase (common mode) currents on all of the helical elements, whereas operation of the QHA drives the four antenna elements 412 with distinct quadrature phased signals, such that the signals on opposite pairs of antenna elements 412 are anti-symmetric. The coupling between the two antennas is preferably less than −25 dB, and more preferably less than −30 dB in the frequency bands of operation of the first communication circuit 304 and the second communication circuit 312 which correspond to the frequency bands of operation of the QHA 404 and the second antenna 420. An added benefit of the antenna system 402 that arises from the isolation, is that the two antennas 306, 310 can be operated simultaneously.

Figure 15:
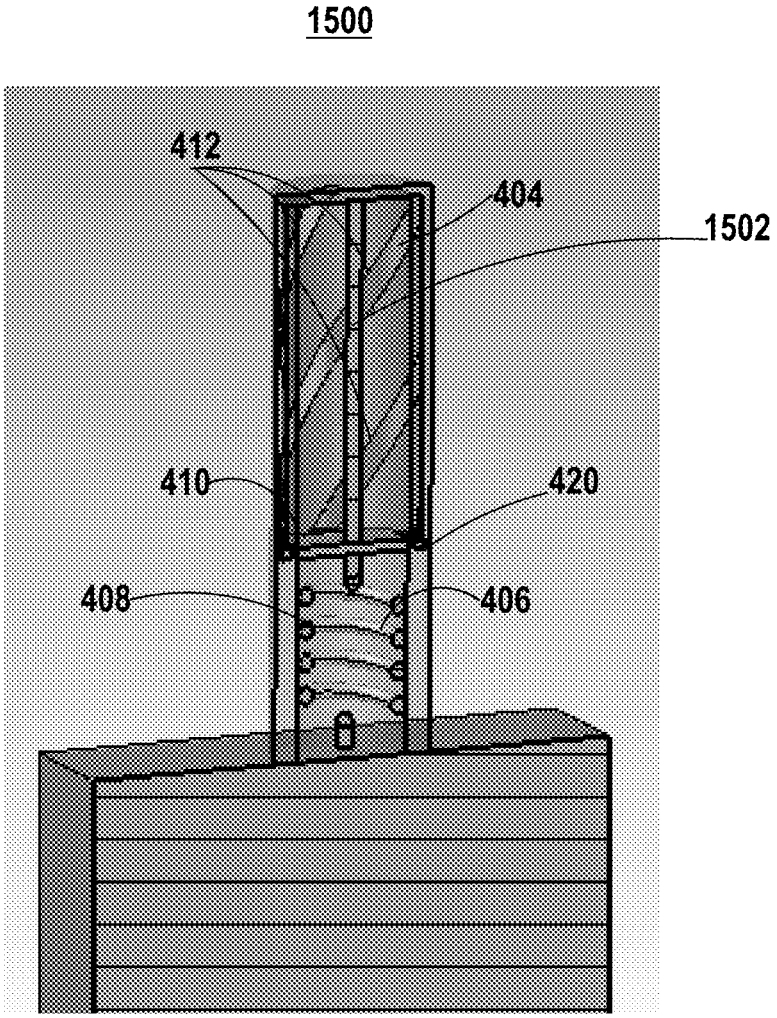
FIG. 15 is a partial cross sectional view of a variation on the antenna shown in FIGS. 4-10.

FIG. 15 is a partial cross sectional view of an antenna system 1500 according to an alternative embodiment of the invention which is a variation on the antenna shown in FIGS. 4-7. This embodiment includes a conductive post 1502 positioned on the centerline (longitudinal axis) of the QHA 404. The conductive post 1502 is galvanically connected to a ground plane layer (not shown) of the round circuit board 410, and the outer conductor 424 of the co-axial cable 408 is also galvanically connected to the aforementioned ground plane layer, so that there is a galvanic connection between coiled section 414 of the co-axial cable through to the conductive post. It should be noted that because the helical elements 412 are coupled through capacitors 1022 to the ground plane of the round circuit board 410 and in-turn to the coiled section 406 of the co-axial cable 408, the electrical extension they provide for the purpose of the dipole radiation motion is somewhat less than indicated by their physical length. Because the conductive post 1502 is galvanically coupled there is no such shortening effect.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A wireless communication device antenna system comprising:

a first antenna;

a coaxial feed line having an inner conductor and an outer conductor, each of the inner conductor and the outer conductor coupled to the first antenna, the coaxial feed line having a length, wherein a first portion of said coaxial feed line is coiled in shape;

a first communication circuit connected between the inner conductor and the outer conductor of the coaxial feed line and coupled to said first antenna through the outer conductor and the inner conductor of said coaxial feed line;

a second antenna comprising the outer conductor of the first portion of said coaxial feed line as an active antenna element; and a second communication circuit having a hot side and a ground side respectively connected between the outer conductor of the coaxial feed line and a ground, and further comprising a coupling of the second communication circuit to said second antenna consisting essentially of the hot side coupling through the outer conductor of the coaxial feed line.

2. The wireless communication device antenna system according to claim 1 wherein said second antenna also comprises said first antenna as an active element.

3. The wireless communication device antenna system according to claim 1 wherein: said first antenna comprises a quadrifilar helix antenna.

4. The wireless communication device antenna system according to claim 3 wherein said quadrifilar helix antenna comprises a longitudinal centerline and said antenna system further comprises a conductive post positioned on the longitudinal centerline and wherein said conductive post is coupled to said coaxial feed line.

5. The wireless communication device antenna system according to claim 1 wherein the coupling of the second communication circuit to said second antenna consists essentially of the hot side of said second communication circuit directly and electrically connected to the outer conductor of said coaxial feed line.

6. The wireless communication device antenna system according to claim 5 wherein said second communication circuit is coupled to said coaxial feed line at an intermediate position between a second portion of the coaxial feed line and the first portion of the coaxial feed line along the length.

7. The wireless communication device antenna system according to claim 6 further comprising a printed circuit board, the printed circuit board having a peripheral edge and wherein a second portion of the coaxial feed line overlies the printed circuit board and the first portion of said coaxial feed line is located outside the peripheral edge of the printed circuit board.

8. The wireless communication device antenna system according to claim 1 wherein said first antenna and said second antenna exhibit a maximum coupling within frequency bands of operation of said first communication circuit and said second communication circuit of less than 25 dB.

9. The wireless communication device antenna system according to claim 1 wherein the maximum coupling within frequency bands of operation of said first communication circuit and said second communication circuit is less than 30 dB.

10. At least one communication system comprising the wireless communication device antenna system according to claim 1.

11. The wireless communication device antenna system according to claim 1, wherein the first communication circuit operates at a first frequency;

wherein the second communication circuit operates at a second frequency;

wherein the first antenna comprises a quadrifilar helical antenna that supports an operating band at said first frequency; and wherein the first portion of the coaxial feed line coiled in shape in combination with said quadrifilar helical antenna supports an antenna operating band at said second frequency.

12. The wireless communication device antenna system according to claim 3 wherein said first portion of said coaxial feed line that is helical in shape and said quadrifilar helix antenna share a common helical axis.

13. The wireless communication device antenna system according to claim 1 further comprising a printed circuit board, said printed circuit board having a peripheral edge and wherein a second portion of the coaxial feed line overlies said printed circuit board and said first portion of said coaxial feed line is located outside said peripheral edge of said printed circuit board.

14. The wireless communication device antenna system according to claim 13 wherein said first antenna comprises a quadrifilar helix antenna and said first portion of said coaxial feed line that is helical in shape and said quadrifilar helix antenna share a common helical axis.

* * * * *